US005267464A

United States Patent [19]

Cleland

[11] Patent Number: 5,267,464

[45] Date of Patent: Dec. 7, 1993

[54] PIPE RING CRIMPING TOOL

[76] Inventor: John G. Cleland, 7008 Branton Dr., Apex, N.C. 27502

[21] Appl. No.: 813,743

[22] Filed: Dec. 30, 1991

[51] Int. Cl.[5] ..... B21D 41/04

[52] U.S. Cl. ..... 72/410; 29/237; 81/367; 81/383

[58] Field of Search ..... 72/410, 409, 451; 81/381, 383, 367, 345, 313, 371, 372, 382, 377-380; 29/751, 750, 237

[56] References Cited

U.S. PATENT DOCUMENTS

| | | | |
|---|---|---|---|
| 542,035 | 7/1895 | Willever | 81/363 |
| 1,910,838 | 5/1933 | Jensen | 72/409 |
| 2,503,783 | 4/1950 | Ward | 81/367 |
| 2,532,659 | 12/1950 | Burns | 81/371 |
| 2,556,725 | 6/1951 | Hurlbut | 72/409 |
| 2,908,114 | 10/1959 | Fouse | 81/367 |
| 2,988,941 | 6/1961 | Ortman | 81/383 |
| 3,170,345 | 2/1965 | Poingt | 72/409 |
| 3,393,438 | 7/1968 | Marley | 72/410 |
| 3,837,211 | 9/1974 | Gress | 72/410 |
| 4,005,516 | 2/1977 | Bakermans | 29/751 |
| 4,040,179 | 8/1977 | Sanchez | 29/751 |
| 4,611,511 | 9/1986 | Mykkanen | 72/410 |

FOREIGN PATENT DOCUMENTS

| | | | |
|---|---|---|---|
| 1522144 | 8/1978 | United Kingdom | 72/410 |

*Primary Examiner*—Daniel C. Crane

*Attorney, Agent, or Firm*—Armstrong, Westerman, Hattori, McLeland & Naughton

[57] ABSTRACT

A pipe ring crimping tool providing significant mechanical advantage for applying force with a sufficient jaw opening and minimal external dimensions, minimal handle span and minimal handle length throughout the operational cycle. The tool is compact and lightweight to allow reach and access of the jaws into confined spaces. The tool utilizes a link and pin mechanism to translate the operator hand force exerted on the handles into a crimping force in a manner which allows for smooth application of operator hand force while increasing the crimping force as the pipe ring is compressed. The tool configuration by minimizing the handle spread, allows for single-handed operation of the tool or closely held two-handed operation. The tool includes a link mechanism designed to provide smooth crimping force and to preclude tool locking up and excess friction. The handles move laterally in opening the jaws to their maximum spread and are closed rotationally when crimping the pipe ring.

15 Claims, 9 Drawing Sheets

PIPE RING CRIMPING TOOL

BACKGROUND OF THE INVENTION

The present invention relates to pipe clamping tools. More specifically, the present invention relates to a tool for crimp fitting of metal to plastic pipe.

There are tools available for crimping a variety of materials for a number of applications. These tools include devices for pipe clamping or crimping such as taught in the patents to Batcheller 4,286,372 and Burli 4,735,442.

Also, devices are known for the crimping and connecting of wire joints, such as those taught in Filia 3,523,351; Blagojevich 3,481,373; Matthysse 2,994,238; Filia 3,277,751 and Filia 3,487,524 which teach various mechanisms for translating a handle closing into a clamping force.

These known devices are often significantly bulky and difficult to use in a confined area or with a single hand operation. These tools often have extended handles utilized to achieve the necessary clamping or crimping force.

Users of these devices encounter difficulties due to the heavy, bulky, and often clumsy nature of these devices which are often inefficient, and difficult or impossible to use in specific applications.

One particular operation for which it is important to have a convenient, lightweight and easy to use crimping tool is in the crimping of copper bands onto plastic pipe. In the crimping operation, the plastic pipe slides onto copper or brass fittings (in some applications plastic fittings are used), and is crimped in place using copper rings which squeeze the pipe around each fitting connection. Often pipe joints are located in constricted access locations. It is also difficult to align a long-handled tool on the crimp ring. A clumsy operation is more likely to result in misalignment of the ring or movement of the ring from the proper position. Misalignment or improper location can result in a leaky fitting. Therefore, it is advantageous to eliminate long handles and handles which require a wide range of movement to open the crimping jaws and to crimp a fitting, as they can prove a detriment to the fitting of the pipe clamping devices in constricted locations. Also it is often difficult to utilize a two hand tool in constricted locations.

Currently, pipe connections are made by mechanical seal using copper rings which are crimped by tools. At least two copper crimp rings are needed for every fitting connection.

The crimping tools which are now predominantly used are bolt cutters having jaws modified for crimping instead of cutting. The devices have elongated handles which must be opened up to a span of over two feet from tip to tip to allow the jaw to fit over a crimp ring. The prior art devices also require two handed operation with hands far apart and elbows out, a difficulty when working on ladders or in tight spaces. The tools require significant operator applied force in spite of long mechanical advantage. These force and orientation requirements often cause difficulty in keeping tool properly aligned on a crimp ring. Also the crimping jaws themselves must be opened to a wide span which can cause difficulties in constrained areas.

SUMMARY OF THE INVENTION

It is an object of the present invention to improve the convenience and efficiency of one of the most important and common assembly operations by plumbers, the crimp connection of pipe.

It is another object of the invention to provide a device which provides a pipe clamping device allowing the operator to apply the necessary force while eliminating the bulky heavy nature of current pipe clamping devices.

It is another object of the present invention to provide a convenient, lightweight crimping tool which allows for single hand operation. The device of the present invention is compact and light weight allowing for single hand manipulation of the device, and provides a single hand grip which allows application of sufficient force to crimp a pipe fitting and provides positive feedback when the fitting has been properly crimped.

These and other objects of the present invention are satisfied by the hand tool for pipe crimping taught in the present invention.

The crimping tool of the present invention is lightweight, rugged, and inexpensive to produce. The tool can be operated with one hand (or two hands close together dependant upon the operator), moderate force, and a single power stroke. The teachings of the tool of the present invention can also be utilized in other applications requiring crimping, without departing from the scope of the invention as herein taught.

The tool as herein taught provides a significant mechanical advantage for applying force; a maximum jaw opening with minimal external dimensions; a minimized handle span and length throughout the operational cycle allowing one-handed operation; compact overall dimensions; structural integrity to allow application of significant jaw force with minimal deformation or deflection; and simple release by releasing handle compression and pulling on the moving handle.

The tool dimensions and geometry are important to the design in terms of compactness, weight, appearance, balance, and ease of handling. The handles are shaped to allow additional reach and accessibility of the jaws into confined spaces. The profile of the jaws and body are minimized within the restrictions of tool strength and rigidity to maximize access, minimize weight and ease handling and operation.

The link and pin locations maximize mechanical advantage within the restrictions of single-handed (or two hand) operation which prevents the handle spread from exceeding a maximum determined by the average palm spread of an operator's hand.

The link and pin locations taught preclude the tool from locking up, from encountering excess friction, and from inhibiting smooth operation.

The device is ideally designed for single handed operation. The handles are provided with a spring tension that lightly tends to close the jaws.

In the process of clasping and crimping a sealing ring, two distinct but blended motions of the handles are performed in sequence. With the jaws in the fully open position, at the arc required to easily slip over an uncrimped ring, a slight gripping force applied to the handles urging them toward each other will lock the linking mechanism and hold the jaws in the open position. The jaws are prevented from opening too far by a small stop built into the tool body that limits the rotation of the moving jaw. With the split circular opening in position enclosing the ring, the first motion is executed by release of the gripping pressure while still holding both handles, thus allowing the handles to move slightly apart. The moving handle will move laterally toward the tool body, allowing the linkage assembly enough rotation so that the jaws lightly engage the crimp ring with a remaining minimal outer jaw gap. The hand grip is then at a comfortable opening to begin the power stroke.

The second motion is the single power stroke, beginning with the handles near the maximum opening and ending with handle closure, about 1 inch. Maximum force is exerted at an optimum hand width opening for single hand or two hand operation. The final stroke's mechanical advantage allows a force of up to 3000 pounds to be exerted on the ring with a manageable operator force. Hand force may be noticeably less, since ring and fitting resistances and dimensions have some variability. A nominal ½ inch pipe fitting ring will be compressed from an initial diameter of about 0.752 inch to about 0.710 inch.

Upon release of handle compression at the end of the power stroke, the jaws spring slightly apart, while still engaging the crimped ring. At this point, the fixed handle is released and the tool is easily pulled away from the crimped ring by the moving handle. The moving handle is then rotated away from the fixed handle and moved laterally away from the tool body forcing the jaws open to their maximum. The gripping pressure is reapplied to the handles and the crimp cycle can now be repeated.

The design taught in the present invention minimizes friction in the linkage and pin design and through shaping of the jaw surfaces which engage with the crimp ring to various angles to minimize friction and scraping and linkage and pin contact with the sidewalls of the tool body is minimized.

BRIEF DESCRIPTION OF THE DRAWINGS

For a better understanding of the nature of the present invention, reference is had to the following figures and detailed description, wherein like elements are accorded like reference numerals, and wherein:

FIG. 4A is a side view of the tool of the present invention with one face removed, illustrated in closed position, FIG. 4B is in partially open position and FIG. 4C is fully opened.

DETAILED DESCRIPTION OF PREFERRED EXEMPLARY EMBODIMENTS

Figure 1:
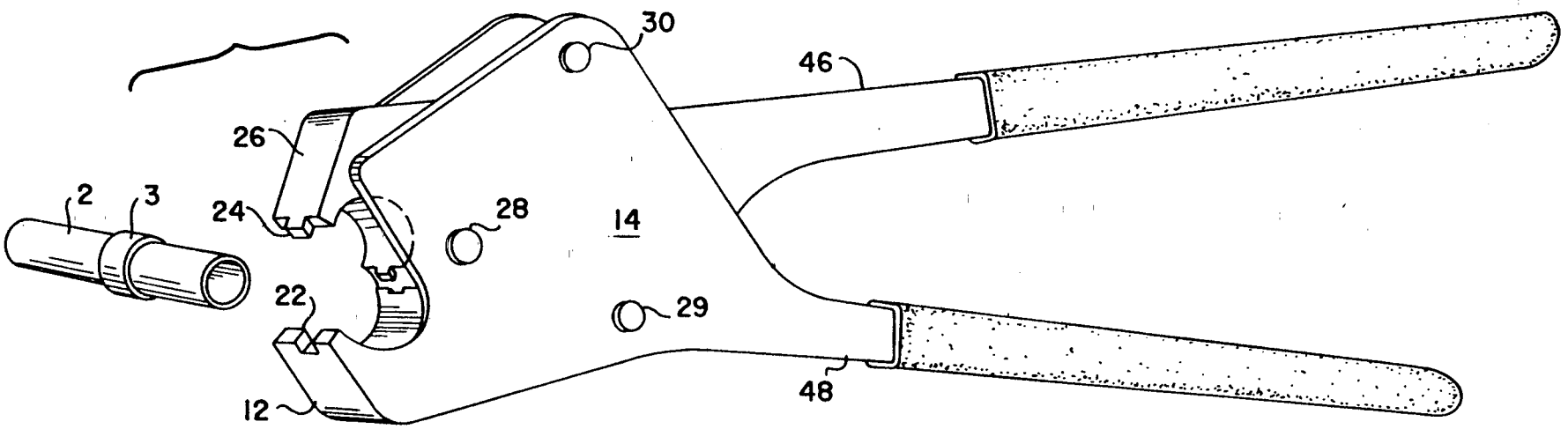
FIG. 1 is a perspective view of a first double over-center embodiment of the tool of the present invention.

As illustrated in FIG. 1, crimp ring 3 fits over pipe 2. The crimping procedure comprises sliding the pipe 2 and crimp ring 3 over a fitting and then compressing the ring with a crimp tool to seal. The jaws 12 and 26 are positioned around the ring 3 and then closed to clamp the ring 3 in position about the pipe 2.

Figure 2:
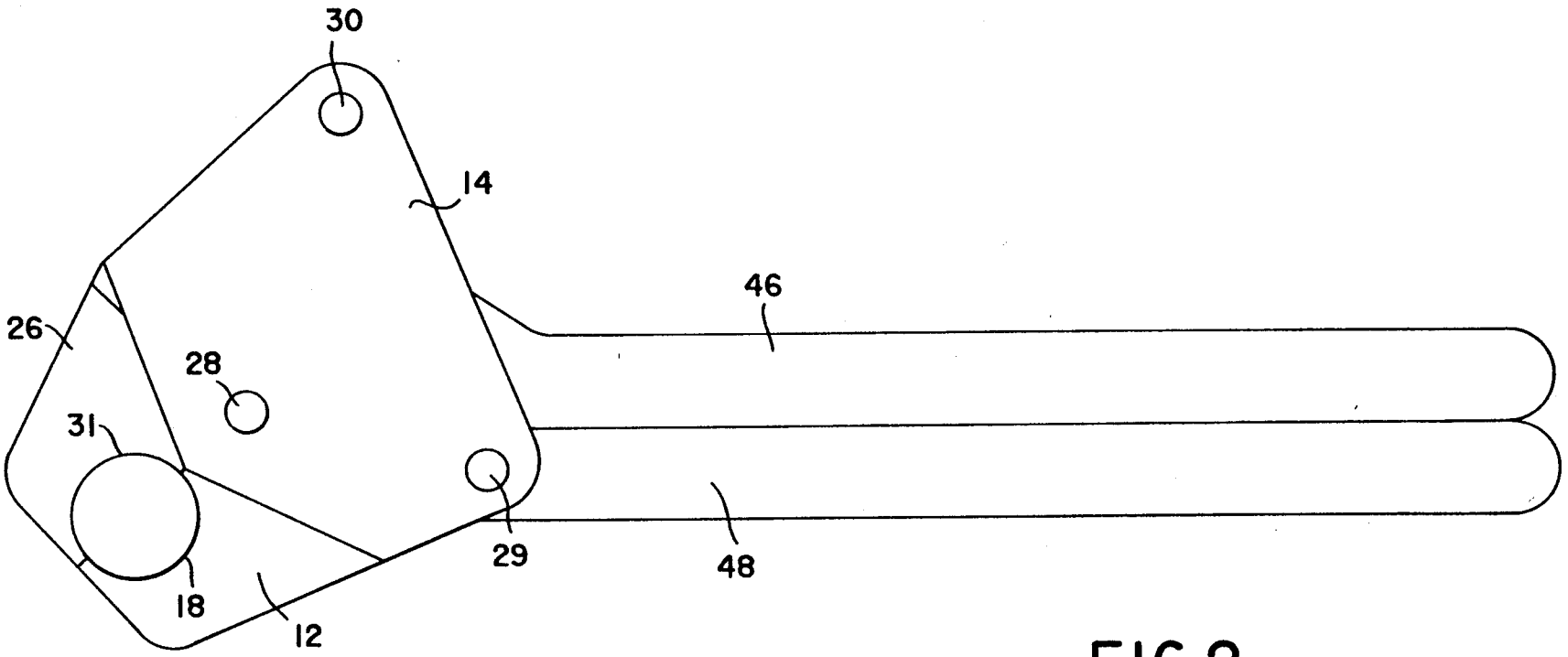
FIG. 2 is, a side view of first embodiment of the tool of the present invention.
Figure 3:
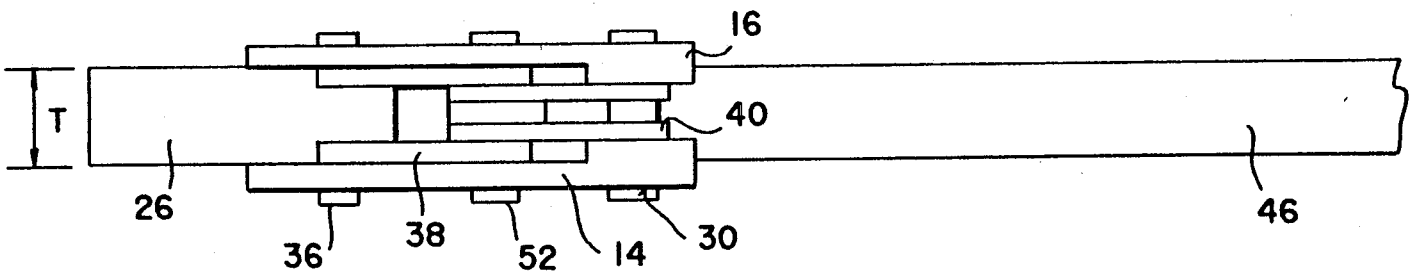
FIG. 3 is a top view of the first embodiment of the tool

As illustrated in FIGS. 1, 2 and 3, the tool has two integral or rigidly attached side plates 14 and 16 and a fixed jaw 12 rigidly attached to the side plates or alternatively formed integrally therewith. A half hole 18 of a diameter selected to insure adequate compression of a desired size crimp ring is formed in fixed jaw 12. The minimum thickness of the jaws 12 and 26 is preferably slightly greater than the width of the desired crimp ring (e.g., about 0.30 inch for a ½ inch fitting ring). An additional thickness over the minimum is desirable and the thickness may be in the range of 25% to 50% greater than the width of the ring.

There are 2 commonly used nominal pipe sizes, ½ inch and ¾ inch, therefore two tools or two sets of jaws would be sufficient to accommodate most applications. Separate tools can be used for different size crimp rings, each tool having jaws sized for a particular ring dimension. Alternatively, a single tool can be configured to accommodate various sizes of crimp rings through the use of interchangeable jaws, or through the use of an insertable die to reduce a ¾" jaw opening to a ½" jaw opening.

The front of the fixed jaw 12 has a slot 22 in the direction of the tool axis that mates with a tongue 24 on the moving jaw 26. Tongue 24 and slot 22 allow conforming of the ring 3 to eliminate scraping and detrimental surface friction during initial jaw closure.

Moving Jaw 26 is provided with a matching half hole 31, complementary to half hole 18 in the fixed jaw 12, for compression of the crimp ring 3. The moving jaw 26 is attached to the faces 14 and 16 by a pivot pin 28 and to the linkage assembly at the front drive pin 36. The front of the moving jaw 26 has a tongue 24 for mating with the fixed jaw 12. Moving jaw 26 typically pivots through a maximum angle of less than 40 degrees during a complete crimping cycle.

The faces 14 and 16 have three through holes to accommodate pins 28, 29 and 30 at precise locations for proper application of crimping force and to ensure that the proper final diameter is achieved within the jaw opening 18/31 to compress the ring 3 to the proper fit about the pipe 2.

Figure 4A:
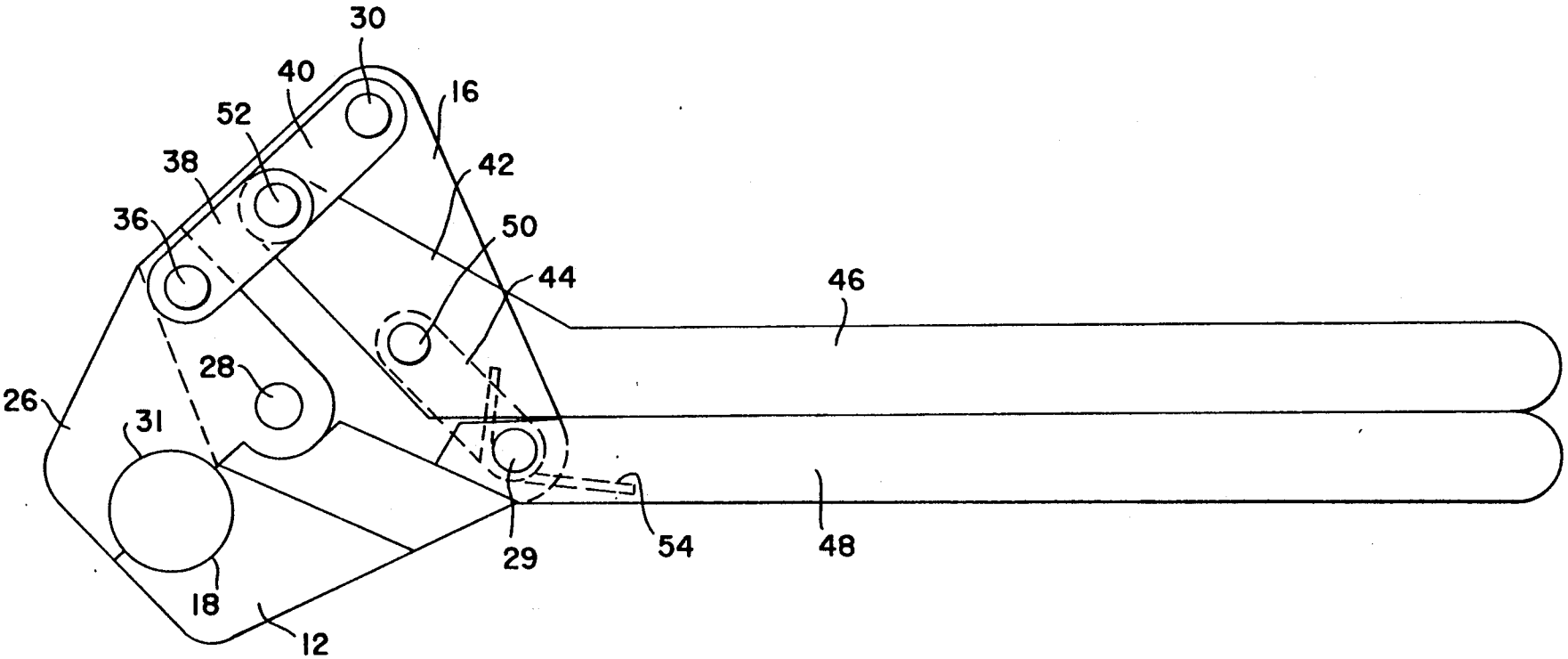
FIGS. 4A–4C are sequential views illustrating the linkage operation and clamping sequence of the tool of the present invention.
Figure 4B:
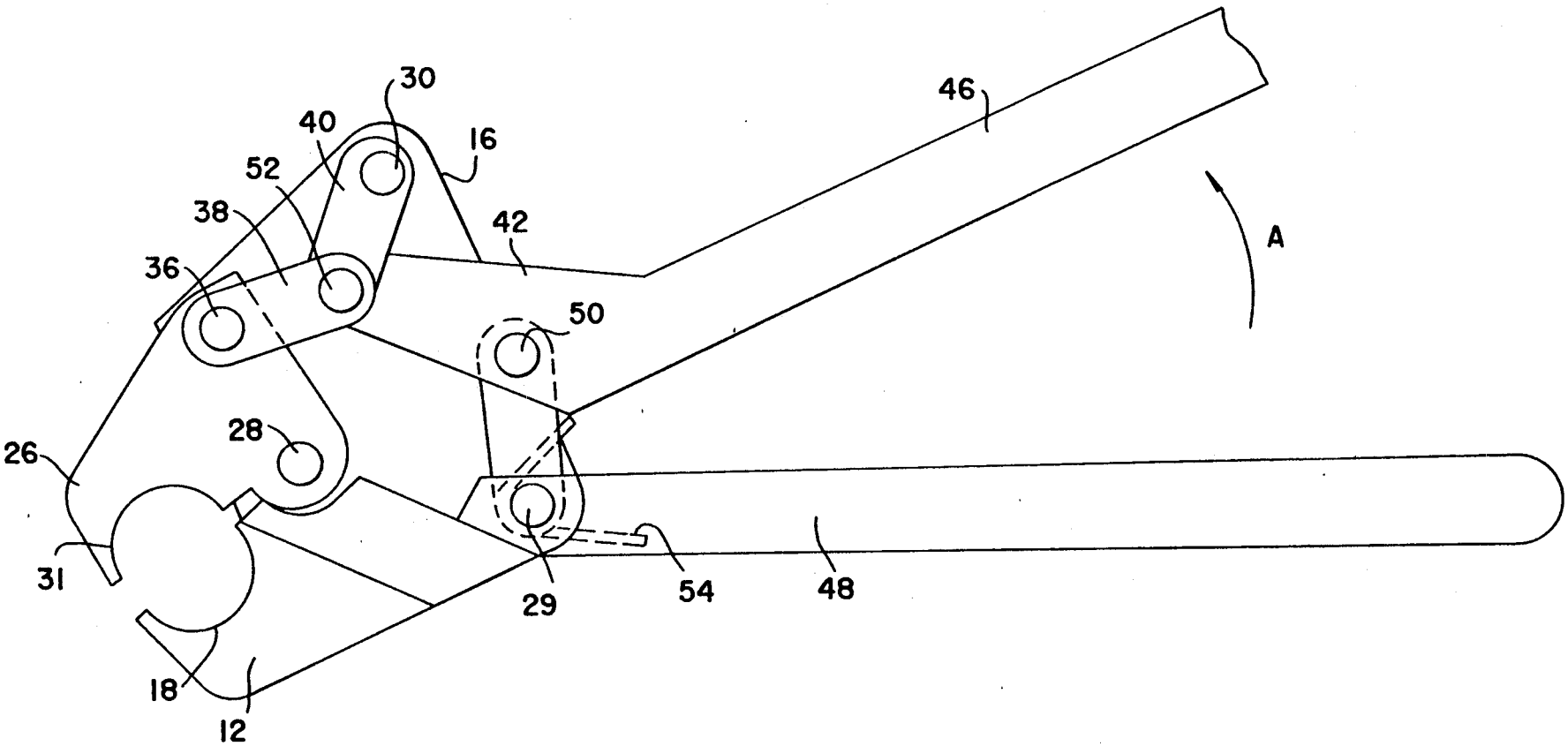
Figure 4C:
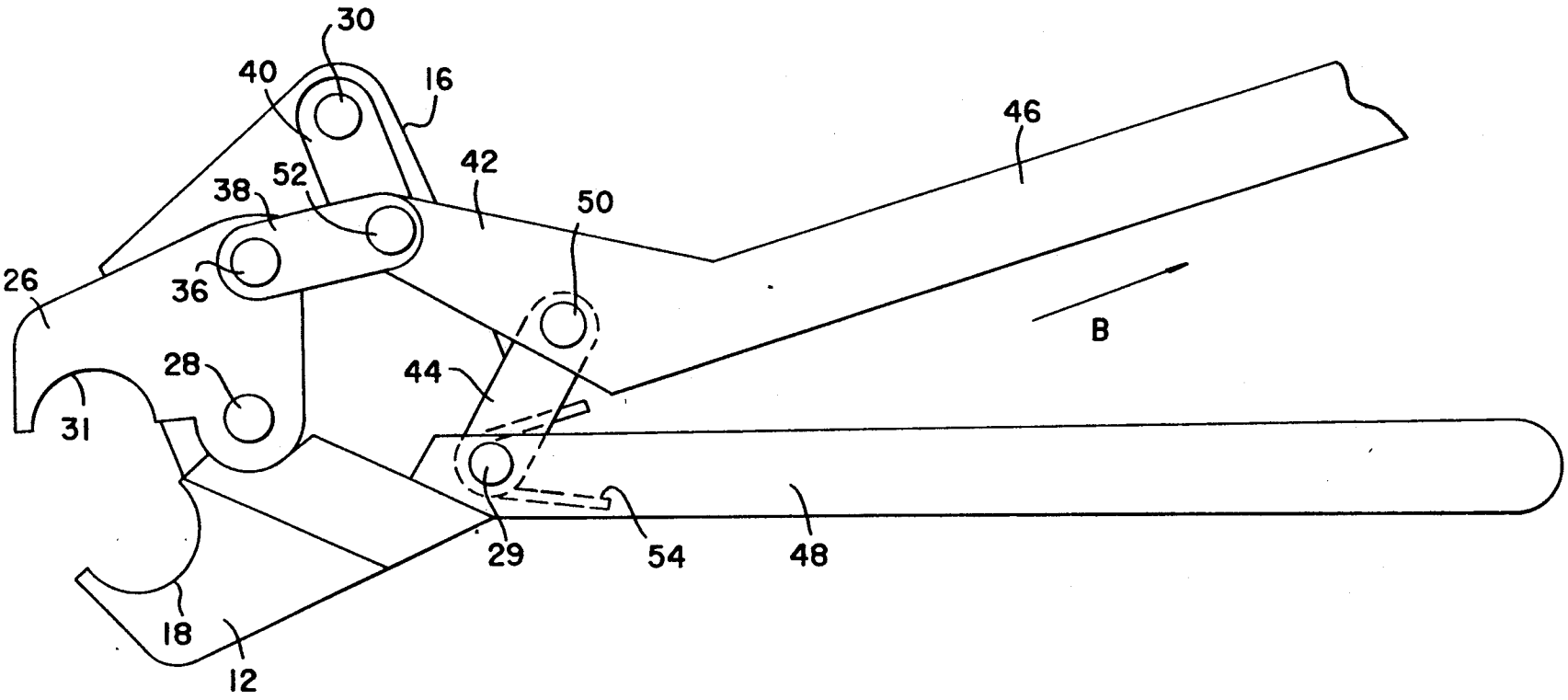

As illustrated in FIG. 4A–4C, the linkage assembly includes front drive link 38, back drive link 40, upper link 42 (the upper portion of moving handle 46), and lower handle link 44. Links 38, 40, and 42 may each be comprised of a single piece or of two or more link pieces laid in parallel, the exact combinations being a function of the availability and cost of links at desired thicknesses.

There are two handles, fixed handle 48 affixed to or otherwise held stationary relative to stationary jaw 12 and faces 14 and 16, and moving handle 46 attached the linkage assembly. Lower handle link 44 extends between handle 48 and handle 46 to allow rotational and lateral movement of handle 46 with respect to stationary jaw 12, for opening and closing of moving jaw 26. Handle 48 cannot rotate about the axis of pin 29, while lower link 44 rotates freely about pins 29 and 50. Moving handle 46 is pivotally attached at the lower handle pin 50 and to the drive links at middle drive link pin 52.

The six pins 28, 29, 30, 36, 50 and 52 each allow free rotation of the links 38, 40 and 44, moving handle 46 and moving jaw 26. Of these pins, only jaw pin 28, lower handle pin 29 and back drive pin 30 extend through the faces 14 and 16 and are secured with snap rings, cotter pins, by swaging or through other acceptable means.

The other pins are restricted from axial movement by the interior walls of faces 14 and 16.

Spring 54 is fixed in place about pin 29 and provides a forward bias to lower link 44, so as to move the handles toward a closed jaw position.

As illustrated in FIGS. 4A–4C, the opening and closing of the jaws 12 and 16 is accomplished by rotation and translation of the moving handle 46. FIG. 4A illustrates the jaws 12, 26 in fully closed position. In FIG. 4B, moving handle 46 has been rotated in the direction of arrow A and the laws 12, 26 have been rotated slightly open to a diameter greater than that of an uncrimped pipe ring. Lateral movement of moving handle 46 in the direction of arrow B, FIG. 4C, opens the jaws 12, 26 wide enough to fit around the ring and pipe so that the tool can be properly positioned. Through the translation of the moving handle 46, the jaws are opened wide without increasing the spread of the handle ends. The jaws are then held open by squeezing the handles toward each other in the direction opposite arrow A, which locks up the linkage mechanism by holding the back side of the moving jaw 26 against a small stop in the tool body and prevents movement.

Once the jaws 12, 26 surround the desired pipe ring, the squeezing pressure is released slightly while maintaining a grip on the handles, and spring 54 urges the lower handle link 44, moving the moving handle 46 in the direction opposite arrow B and closes the jaws to the position illustrated in FIG. 4B where the jaws 12, 26 lightly hold the pipe ring. Next, the gripping force form the hand of the operator is applied to the handles 46, 18 in the direction opposite arrow A, and the crimping is begun. As pressure is applied, the front 38 and rear 40 links are moved upward and jaws 12 and 26 are closed with a crimping force which increases as the diameter of the jaw opening decreases.

Figure 6:
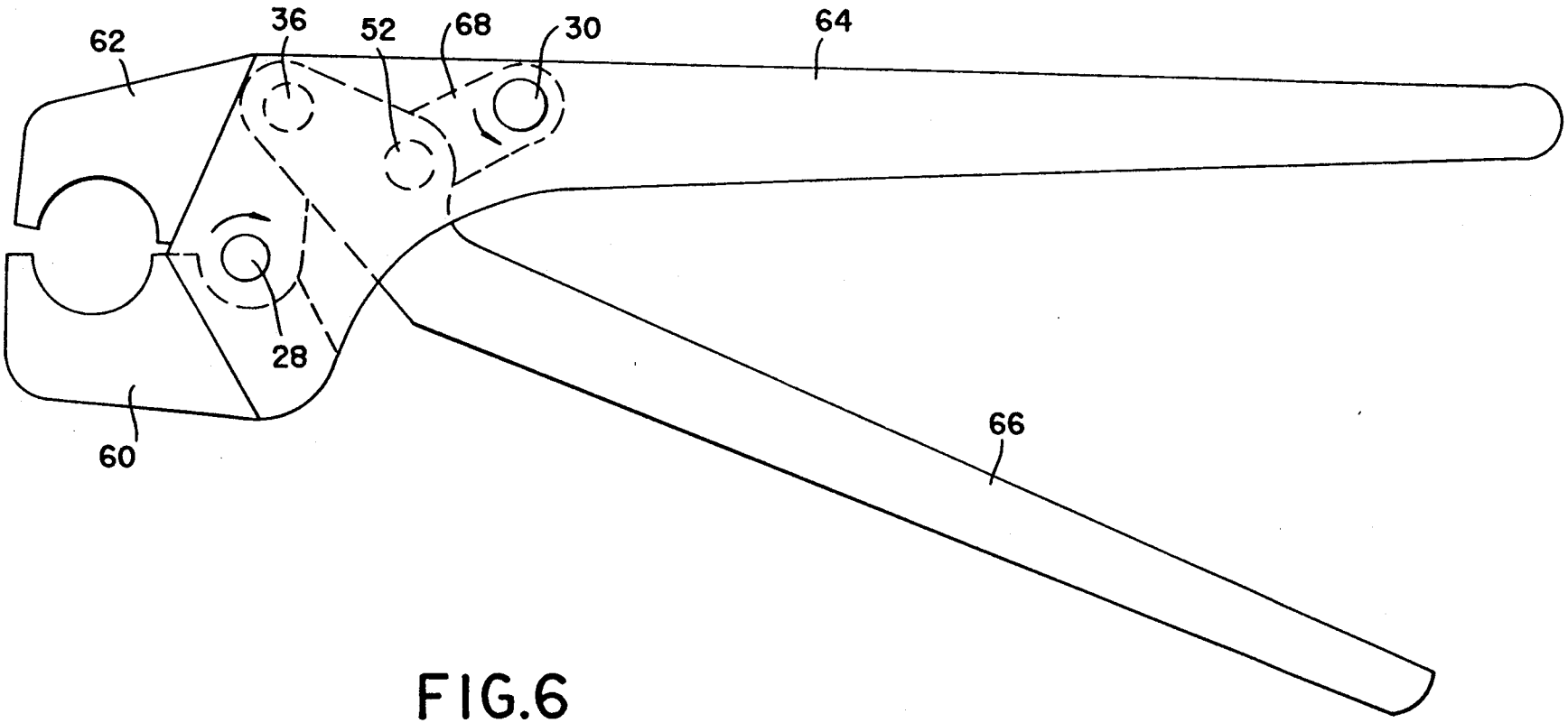
FIG. 6 is a side view illustrating a second, single over-center, embodiment of the present invention.

The second embodiment of the present invention utilizes the single over-center linkage, as illustrated in FIG. 6. This embodiment has a fixed jaw 60 and a moving jaw 62, a fixed handle 64 and a moving handle 66 and a single back drive linkage 68. The moving handle 66 operates as the front drive linkage and the third linkage is eliminated.

Both embodiments of the present invention utilize the reverse rocker linkage configuration taught herein, where the middle drive pin 52 moves away from the axis formed by the jaw pivot 28 and the line of jaw mating rather than toward it during the compression stroke. This also means that the action of the moving handle 46 or 66 is always on the opposite side of the tool axis and jaw pivot point 28 from the moving jaw 26 or 62. This is true of both the first embodiment, double over-center and the second embodiment, single over-center designs described herein.

The combination of the reverse rocker with the use of the upper portion of the moving handle as a link, allows a combination of handle transnational and rotational motion. The translational behavior of the handle as the jaws are widened is also attributable to the proper length relationships between all links and the jaw pivot. This in turn allows a unique ability to swing the jaws well open with minimal increased spread of the handles, and then to apply a very large force over a short rotational distance during the final movement of the crimp. In the first, double over-center, embodiment of the tool, the moving handle 46 is decoupled from the moving jaw 26, while for the second, single over-center, embodiment of the tool, the moving handle is pinned to the moving jaw 62.

The double over-center linkage allows for the force applied by the jaws as a result of uniform force applied to close the handles, to closely follow the crimp ring load. The term double over-center linkage is used to describe the assembly where the front and rear drive links 38 and 40 are forced upward by the handle links 42 and 44. The drive links and jaw pivot are actually a rocker mechanism with on-center force. The handle links are moved by the over-center leverage of the lower moving handle with mechanical advantage equal to (lower handle length) ÷ (upper handle length). The double over-center linkage design allows a nearly constant hand grip force to produce the increasing pressure required as the crimp progresses. As the moving handle 46 is compressed the inclusive angle between the upper handle 42 and lower handle link 44 approaches 180 degrees, and the upward force becomes large as the upward motion of the middle drive pin 52 becomes small. By the same token, the force on the front drive pin 36 approaches infinity as the moving jaw 26 rotation approaches zero and the jaws close. Thus, handle closure produces a multiplicative, as well as exponential, increase in force. This behavior closely follows the stress-strain profile imposed by the resistance to deformation of the copper ring.

The linkage assembly has been packaged to always maximize mechanical advantage to the level required for crimping and within the following restrictions: handle span not to exceed average hand grip, largest ring accommodated, nearly even hand force throughout crimp, without excessive forces at any point, and no locking or otherwise awkward linkage configurations during operation, that would affect the smooth motion desired. The relative pin locations and link lengths are essential quantities characterizing the design.

The bore hole through the jaws that encloses the crimp ring is not precisely round. The slightly elliptical shape has been optimized to reduce friction during closure, maximize compression, and mold the copper ring to a consistently round shape.

With the single over-center design, the second embodiment illustrated in FIG. 6, the upper handle 65 becomes the front drive link, and the lower handle link is eliminated, so there are 2 links instead of 4. The moving handle 66 is still opposite the moving jaw 62, but the moving handle 66 is pulled back toward the fixed handle 64 during ring compression, instead of being a back-handle push as with the first embodiment. The advantages include a simpler design and fabrication. The disadvantage is a poorer match of hand force with crimp ring resistance.

Figure 5:
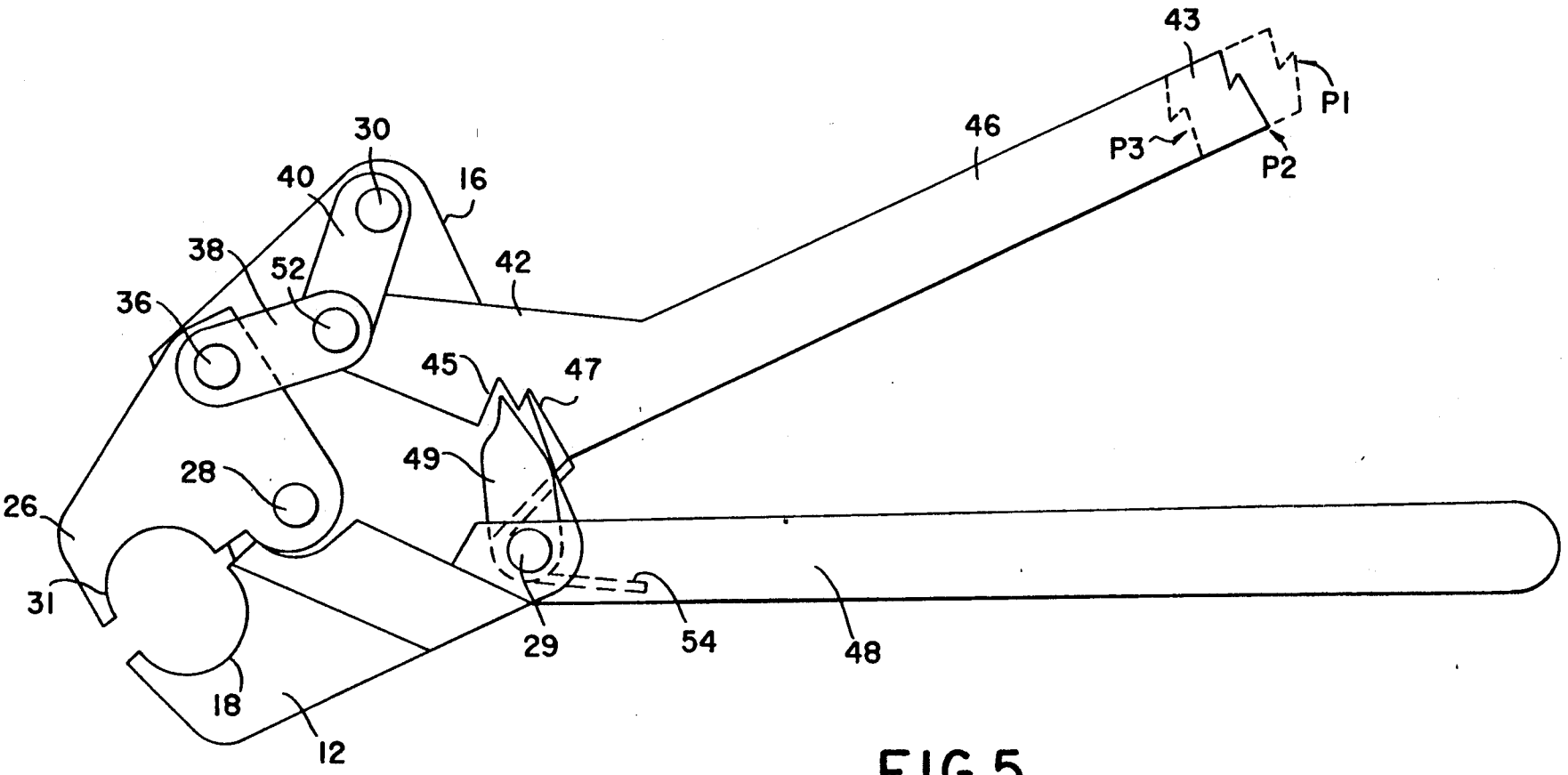
FIG. 5 is a side view of the first embodiment of the tool illustrating the addition of a ratchet drive assembly.
Figure 7:
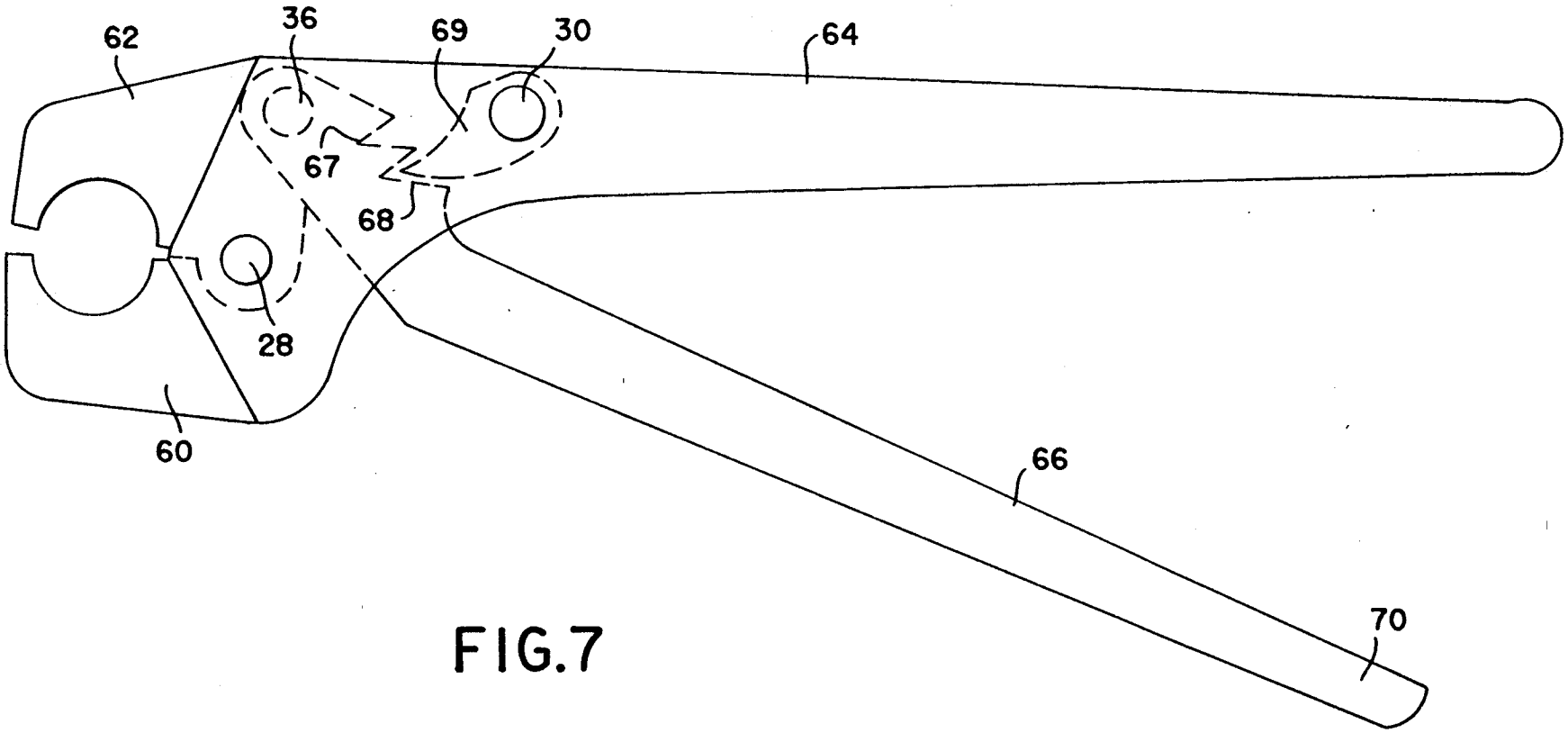
FIG. 7 is a side view of the tool of FIG. 6, illustrating the addition of a ratchet drive assembly.

In certain applications or with certain operators, it may be desirable to reduce the amount of operator force necessary to crimp the jaws with sufficient force. The force applied to the crimping jaws can be maintained while reducing the operator force which must be applied to the handles, without increasing the handle travel, by providing a ratchet which allows the handles to be closed twice during a single closing of the jaws. FIGS. 5 and 7 illustrate exemplary embodiments for providing a ratchet mechanism to the handles. As with the nature of ratchet mechanisms, mechanical advantage is gained by moving the linkage in successive steps toward full crimping closure. Each time the moving handle of the embodiments of FIG. 5 and 7 are moved in a closing direction, the linkage assembly is advanced toward full crimping.

In the double over-center embodiment, FIG. 5, the moving handle 46 is provided with ratchet teeth 45 and 47 and the fixed handle 48 is provided with a pawl 49. The moving handle 46 could be provided with more teeth if desired to further decrease the necessary operator force requirements. To operate the tool, the moving handle 46 is opened as described above, however, during closing the moving handle 46 is reciprocated two or more times, depending upon the number of teeth provided. With each successive stroke of the moving handle 46, the pawl 49 engages the next tooth down the moving handle 46 toward the far end 43.

The pawl 49 is illustrated as engaged in tooth 45 and as such, the moving handle 46 is illustrated as having advanced from position Pl to position P2. With the subsequent stroke, pawl 49 will engage tooth 47 and moving handle 46 will advance to position P3, as the links are advanced accordingly.

In the single over-center embodiment, FIG. 7, the moving handle 66 is provided with teeth 67 and 68 and the fixed handle 64 is provided with a pawl 69. The moving handle 66 could be provided with more teeth if desired to further decrease the necessary operator force requirements. To operate the tool, the moving handle 66 is opened as described above, however, during closing the moving handle 66 is reciprocated two or more times, depending upon the number of teeth provided. With each successive stroke of the moving handle 66, the pawl 69 engages the next tooth down the moving handle 66 toward the far end 70.

Other configurations for implementation of a ratchet mechanism to the tool of the present invention will be apparent to those skilled in the art given the teachings contained herein.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

I claim:

1. A ring crimping tool, comprising:

a first fixed jaw;

a second moving jaw pivotally connected to said first jaw at a first pivot;

a first link pivotally attached to said second jaw at a second pivot;

a second link pivotally attached to said first link at a third pivot and pivotally connected to said first jaw at a fourth fixed pivot; and handle means attached to said third pivot for driving said links through only said third pivot to rotate said second jaw about said first pivot in a first rotational direction while simultaneously rotating said first link in said first rotational direction and said second link in an opposite rotational direction to close said jaws.

2. The tool of claim 1, wherein:

said handle means includes a first handle connected to said third pivot and a second handle rigidly connected to said first jaw, said second jaw rotating about said first pivot to close said jaws upon movement of said first handle toward said second handle.

3. The tool of claim 2, further including:

biasing means for biasing said handles together.

4. The tool of claim 1, wherein:

said handle means drives said links by moving said third pivot between said first and second pivots, forcing said second and fourth pivots farther apart.

5. The tool of claim 1, further comprising:

a third link pivotally attached to said handle means at a fifth pivot and pivotally connected to said first jaw at a sixth pivot.

6. The tool of claim 2, wherein:

said links are dimensioned and said pivots located such that the movement of said handle means is proportionately greater than movement of said jaws during a first portion of said jaw movement and is proportionately less during a second portion of said jaw movement.

7. The tool of claim 6, wherein:

said handles move laterally in opening the jaws to their maximum spread during said second portion and are closed rotationally when crimping said ring during said first portion.

8. A hand tool for ring crimping comprising:

a pair of opposing jaws, comprised of a first fixed jaw and a second moving jaw pivotally connected to said first jaw at a first pivot, said jaws being movable between a ring accepting orientation and a ring crimping orientation;

a pair of driving links having first ends connected at a common fulcrum, a first one of said links having a second end pivotally attached to said second moving jaw and a second one of said links having a second end pivotally attached at a fixed pivot to said first fixed jaw;

a first handle means attached to said fulcrum for applying a force only to said fulcrum to move said jaws between said ring accepting position and said ring crimping position to close said jaws, wherein said application of closing force to said fulcrum rotates said first link in a first rotational direction about its pivot point on the said second moving jaw and rotates said second moving jaw in the same said first rotational direction about its pivot point on said first fixed jaw and simultaneously rotates said second link in the opposite rotational direction about its fixed pivot from said first link and said second moving jaw.

9. The tool of claim 8, wherein:

said handle means a second handle rigidly connected to said first jaw.

10. The tool of claim 9, further including:

biasing means for biasing said handles together.

11. The tool of claim 8, wherein:

said handle means forces said links toward a linear orientation with said second ends oriented toward maximal extension 12. The tool of claim 8, further comprising:

a third link pivotally attached to said first handle means at a pivot and pivotally connected to said first fixed jaw at a pivot wherein the application of force by the first handle means to close said jaws rotates said third link about its pivot on the first fixed jaw in same said first rotational direction as said second moving jaw.

13. The tool of claim 9, wherein:

the movement of said pair of opposing jaws includes a first travel portion during which said ring is crimped and released and a second travel portion during which said jaws are opened widely for ring acceptance and removal;

said links are dimensioned and said pivots oriented such that the movement of said handle means is proportionately greater than movement of said jaws during said first portion of said jaw movement providing mechanical advantage and the movement of said handle means is proportionately less during said second portion of said jaw movement reducing handle spread.

14. The tool of claim 13, wherein:

said handles move laterally during said second portion and are moved rotationally during said first portion.

15. A hand tool for ring crimping comprising:

a pair of opposing jaws, comprised of a first fixed jaw and a second moving jaw pivotally connected to said first jaw at a first pivot, said jaws being movable between a ring accepting orientation and a ring crimping orientation;

a pair of driving links having first ends connected at a common fulcrum, a first one of said links having a second end pivotally attached to said second moving jaw and a second one of said links having a second end pivotally attached at a fixed pivot to said first fixed jaw;

a first handle means attached to said fulcrum for applying a force only to said fulcrum to move said jaws between said ring accepting position and said ring crimping position to close said jaws, wherein said application of closing force to said fulcrum moves said fulcrum away from said first pivot point connecting said jaws to move said jaws into said ring crimping orientation.

* * * * *